US007140132B2

(12) United States Patent
Barton

(10) Patent No.: US 7,140,132 B2
(45) Date of Patent: Nov. 28, 2006

(54) PERPETUAL CALENDAR WHEEL CHART

(76) Inventor: Sean Anderson Barton, 507 E. Jefferson St., Quincy, FL (US) 32351

( * ) Notice: Subject to any disclaimer, the term of this patent is extended or adjusted under 35 U.S.C. 154(b) by 0 days.

(21) Appl. No.: 11/263,707

(22) Filed: Nov. 1, 2005

(65) Prior Publication Data

US 2006/0101677 A1 May 18, 2006

Related U.S. Application Data

(60) Provisional application No. 60/623,969, filed on Nov. 2, 2004.

(51) Int. Cl.
*G09D 3/08* (2006.01)

(52) U.S. Cl. ..... 40/115; 40/495; 283/2

(58) Field of Classification Search ..... 40/115, 40/495

See application file for complete search history.

(56) References Cited

U.S. PATENT DOCUMENTS 658,309 A * 9/1900 Zachrisson ..... 40/113
1,521,899 A * 1/1925 May ..... 40/115

* cited by examiner

*Primary Examiner*—Cassandra Davis

(57) ABSTRACT

A perpetual calendar wheel chart for determining the calendar for a particular year past, present, or future is comprised of two wheel members adapted to rotate about a common center. The first wheel member has in its center indicia representing the tens and ones digits of the year and has around its circumference indicia representing the day of the month. The second wheel member atop the first wheel member is generally transparent and has in its center indicia representing the hundreds and thousands digits of the year for aligning with the ones and tens digits of the year indicia of the first member and has around its circumference twelve transparent windows representing the months of the year that align with the day of the month indicia of the first member to indicate the calendar for a particular year.

15 Claims, 4 Drawing Sheets

10

DATE OF PASCHAL FULL MOON (PFM)

numbers 21 thru 31 represent March 21 thru March 31
numbers 1 thru 18 represent April 1 thru April 18

| | | | | | | | | | | | | | | | | | | |
|---|---|---|---|---|---|---|---|---|---|---|---|---|---|---|---|---|---|---|
| 300's | 25 | 13 | 2 | 22 | 10 | 30 | 18 | 7 | 27 | 15 | 4 | 24 | 12 | 1 | 21 | 9 | 29 | 17 | 5 |
| 400's | 30 | 18 | 7 | 27 | 15 | 4 | 24 | 12 | 1 | 21 | 9 | 29 | 17 | 5 | 25 | 13 | 2 | 22 | 10 |
| 500's | 4 | 24 | 12 | 1 | 21 | 9 | 29 | 17 | 5 | 25 | 13 | 2 | 22 | 10 | 30 | 18 | 7 | 27 | 15 |
| 600's | 9 | 29 | 17 | 5 | 25 | 13 | 2 | 22 | 10 | 30 | 18 | 7 | 27 | 15 | 4 | 24 | 12 | 1 | 21 |
| 700's | 13 | 2 | 22 | 10 | 30 | 18 | 7 | 27 | 15 | 4 | 24 | 12 | 1 | 21 | 9 | 29 | 17 | 5 | 25 |
| 800's | 18 | 7 | 27 | 15 | 4 | 24 | 12 | 1 | 21 | 9 | 29 | 17 | 5 | 25 | 13 | 2 | 22 | 10 | 30 |
| 900's | 24 | 12 | 1 | 21 | 9 | 29 | 17 | 5 | 25 | 13 | 2 | 22 | 10 | 30 | 18 | 7 | 27 | 15 | 4 |
| 1000's | 29 | 17 | 5 | 25 | 13 | 2 | 22 | 10 | 30 | 18 | 7 | 27 | 15 | 4 | 24 | 12 | 1 | 21 | 9 |
| 1100's | 2 | 22 | 10 | 30 | 18 | 7 | 27 | 15 | 4 | 24 | 12 | 1 | 21 | 9 | 29 | 17 | 5 | 25 | 13 |
| 1200's | 7 | 27 | 15 | 4 | 24 | 12 | 1 | 21 | 9 | 29 | 17 | 5 | 25 | 13 | 2 | 22 | 10 | 30 | 18 |
| 1300's | 12 | 1 | 21 | 9 | 29 | 17 | 5 | 25 | 13 | 2 | 22 | 10 | 30 | 18 | 7 | 27 | 15 | 4 | 24 |
| 1400's | 17 | 5 | 25 | 13 | 2 | 22 | 10 | 30 | 18 | 7 | 27 | 15 | 4 | 24 | 12 | 1 | 21 | 9 | 29 |
| os 1500's | 22 | 10 | 30 | 18 | 7 | 27 | 15 | 4 | 24 | 12 | 1 | 21 | 9 | 29 | 17 | 5 | 25 | 13 | 2 |
| os 1600's | 27 | 15 | 4 | 24 | 12 | 1 | 21 | 9 | 29 | 17 | 5 | 25 | 13 | 2 | 22 | 10 | 30 | 18 | 7 |
| os 1700's | 1 | 21 | 9 | 29 | 17 | 5 | 25 | 13 | 2 | 22 | 10 | 30 | 18 | 7 | 27 | 15 | 4 | 24 | 12 |
| os 1800's | 5 | 25 | 13 | 2 | 22 | 10 | 30 | 18 | 7 | 27 | 15 | 4 | 24 | 12 | 1 | 21 | 9 | 29 | 17 |
| os 1900's | 10 | 30 | 18 | 7 | 27 | 15 | 4 | 24 | 12 | 1 | 21 | 9 | 29 | 17 | 5 | 25 | 13 | 2 | 22 |
| os 2000's | 15 | 4 | 24 | 12 | 1 | 21 | 9 | 29 | 17 | 5 | 25 | 13 | 2 | 22 | 10 | 30 | 18 | 7 | 27 |

FOR OTHER YEARS
A = YEAR ÷ 100
B = YEAR mod 19
C = A + 1 − ((A+8)÷25)
D = 4 + A − (A÷4) + (A÷40) − B + (B×20) − (C+3)
E = (D mod 30) + 1
if E < 18 then PFM = E
if E = 18 & B < 11 then PFM = 18
if E = 18 & B ≥ 11 then PFM = 17
if E = 19 then PFM = 18
if E > 19 then PFM = E + 1

12

| | | | | | | | | | | | | | | | | | | |
|---|---|---|---|---|---|---|---|---|---|---|---|---|---|---|---|---|---|---|
| | | | | | | | | | | | | | | 00 | 01 | 02 | 03 | 04 |
| 05 | 06 | 07 | 08 | 09 | 10 | 11 | 12 | 13 | 14 | 15 | 16 | 17 | 18 | 19 | 20 | 21 | 22 | 23 |
| 24 | 25 | 26 | 27 | 28 | 29 | 30 | 31 | 32 | 33 | 34 | 35 | 36 | 37 | 38 | 39 | 40 | 41 | 42 |
| 43 | 44 | 45 | 46 | 47 | 48 | 49 | 50 | 51 | 52 | 53 | 54 | 55 | 56 | 57 | 58 | 59 | 60 | 61 |
| 62 | 63 | 64 | 65 | 66 | 67 | 68 | 69 | 70 | 71 | 72 | 73 | 74 | 75 | 76 | 77 | 78 | 79 | 80 |
| 81 | 82 | 83 | 84 | 85 | 86 | 87 | 88 | 89 | 90 | 91 | 92 | 93 | 94 | 95 | 96 | 97 | 98 | 99 |

| | | | | | | | | | | | | | | | | | | |
|---|---|---|---|---|---|---|---|---|---|---|---|---|---|---|---|---|---|---|
| ns 1500's | 29 | 17 | 6 | 26 | 14 | 3 | 23 | 11 | 31 | 18 | 8 | 28 | 16 | 5 | 25 | 12 | 1 | 21 | 9 |
| ns 1600's | 3 | 23 | 11 | 31 | 18 | 8 | 28 | 16 | 5 | 25 | 12 | 1 | 21 | 9 | 29 | 17 | 6 | 26 | 14 |
| ns 1700's | 9 | 29 | 17 | 6 | 26 | 13 | 2 | 22 | 10 | 30 | 18 | 7 | 27 | 15 | 4 | 24 | 12 | 1 | 21 |
| 1800's | 13 | 2 | 22 | 10 | 30 | 18 | 7 | 27 | 15 | 4 | 24 | 12 | 1 | 21 | 9 | 29 | 17 | 6 | 26 |
| 1900's | 18 | 8 | 28 | 16 | 5 | 25 | 13 | 2 | 22 | 10 | 30 | 17 | 7 | 27 | 14 | 3 | 23 | 11 | 31 |
| 2000's | 25 | 13 | 2 | 22 | 10 | 30 | 17 | 7 | 27 | 14 | 3 | 23 | 11 | 31 | 18 | 8 | 28 | 16 | 5 |
| 2100's | 30 | 17 | 7 | 27 | 14 | 3 | 23 | 11 | 31 | 18 | 8 | 28 | 16 | 5 | 25 | 13 | 2 | 22 | 10 |
| 2200's | 4 | 24 | 12 | 1 | 21 | 9 | 29 | 17 | 6 | 26 | 14 | 3 | 23 | 11 | 31 | 18 | 8 | 28 | 15 |
| 2300's | 10 | 30 | 18 | 7 | 27 | 15 | 4 | 24 | 12 | 1 | 21 | 9 | 29 | 16 | 5 | 25 | 13 | 2 | 22 |
| 2400's | 14 | 3 | 23 | 11 | 31 | 18 | 8 | 28 | 15 | 4 | 24 | 12 | 1 | 21 | 9 | 29 | 17 | 6 | 26 |
| 2500's | 21 | 9 | 29 | 16 | 5 | 25 | 13 | 2 | 22 | 10 | 30 | 18 | 7 | 27 | 15 | 4 | 24 | 12 | 1 |

calendarwheel [revised 2003-12-08]
copyright (c) 2003 Sean Barton, all rights reserved http://www.calendarwheel.com/

Fig. 4

PERPETUAL CALENDAR WHEEL CHART

This application for patents is submitted by Sean Anderson Barton, resident of Quincy, Florida, citizen of the United States. This application claims benefit of Provisional Application No. 60/623,969 filed Nov. 2, 2004.

BACKGROUND OF THE INVENTION

The present invention relates to perpetual calendar wheel chart for manually determining the calendar for a particular year.

Perpetual calendar wheel charts or perpetual calendar devices that can determine the day of the week for a particular date are known in the art. U.S. Pat. No. 5,930,924 to Beard, U.S. Pat. No. 5,313,723 to Cregg, and U.S. Pat. No. 5,289,649 to Perez are examples of devices that are capable of such a task. However, the problem with these devices is that they are relatively complex devices that are relatively difficult to manufacture, operate, and store.

Therefore, there is a need in the art for a device that can quickly and accurately determine the calendar for an entire particular year such that the device is not unduly complex or bulky and is relatively inexpensive to build. Such a device should be relatively simple to operate and should be able to determine the calendar for years past, present, and future.

BRIEF SUMMARY OF THE INVENTION

The perpetual calendar wheel chart of the present invention addresses the aforementioned needs in the art. The perpetual calendar wheel chart provides for a device that accurately determines the calendar for a particular year and is of relatively simple design and construction and is relatively easy to use.

The perpetual calendar wheel chart is comprised of two wheel members adapted to rotate about a common center. The first wheel member has in its center indicia representing the tens and ones digits of the year and has around its circumference indicia representing the day of the month. The second wheel member atop the first member is generally transparent and has in its center indicia representing the hundreds and thousands digits of the year for aligning with the ones and tens digits of the year indicia of the first member and has around its circumference twelve transparent windows that align with the day of the month indicia of the first member to indicate the arrangement of the days in each month of a particular year.

BRIEF DESCRIPTION OF THE SEVERAL VIEWS OF THE DRAWING

FIG. 4 is a bottom elevation view of the first wheel member of the perpetual calendar wheel chart.

DETAILED DESCRIPTION OF THE INVENTION

Figure 1:
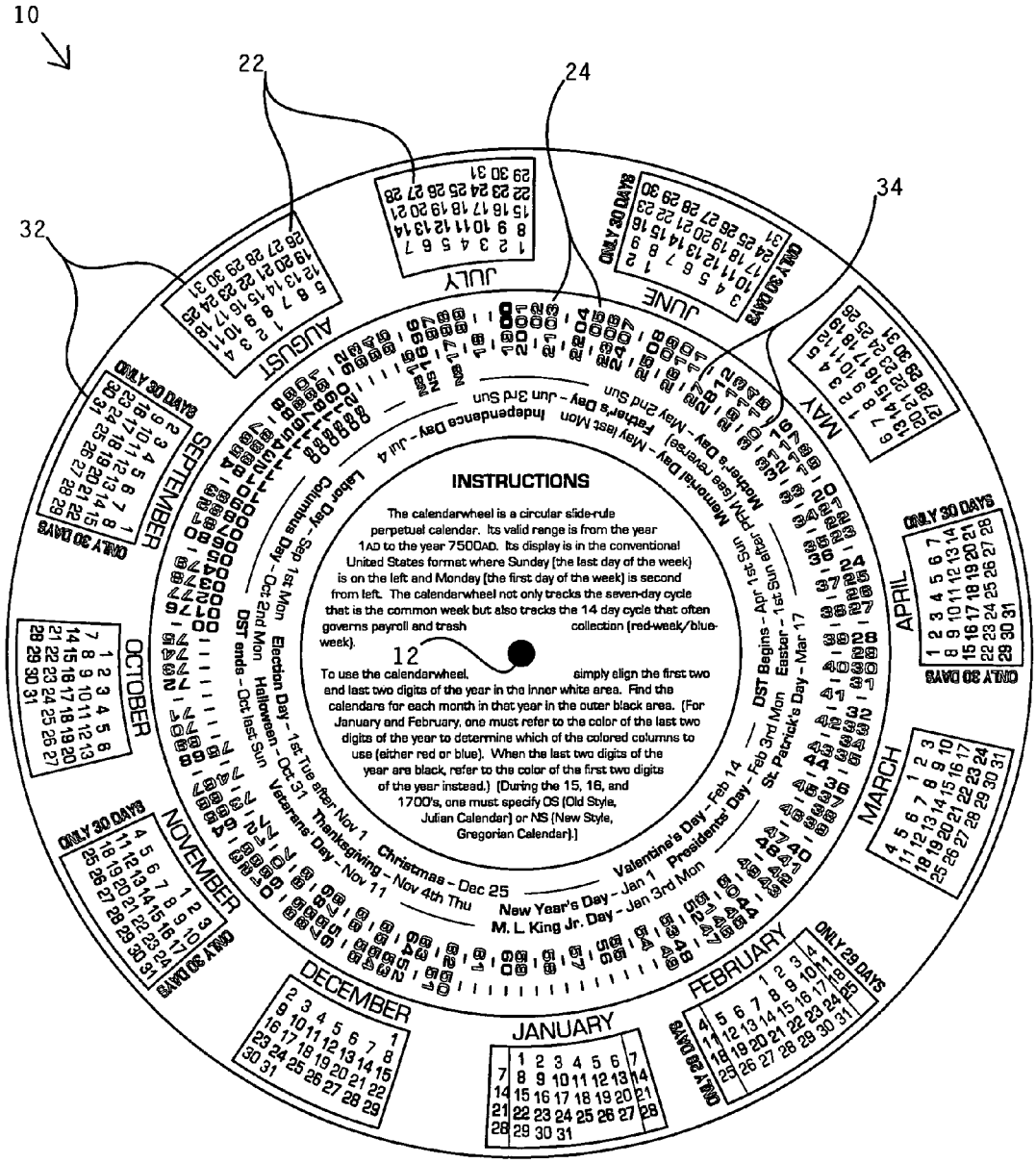
FIG. 1 is a top elevation view of the perpetual calendar wheel chart.
Figure 2:
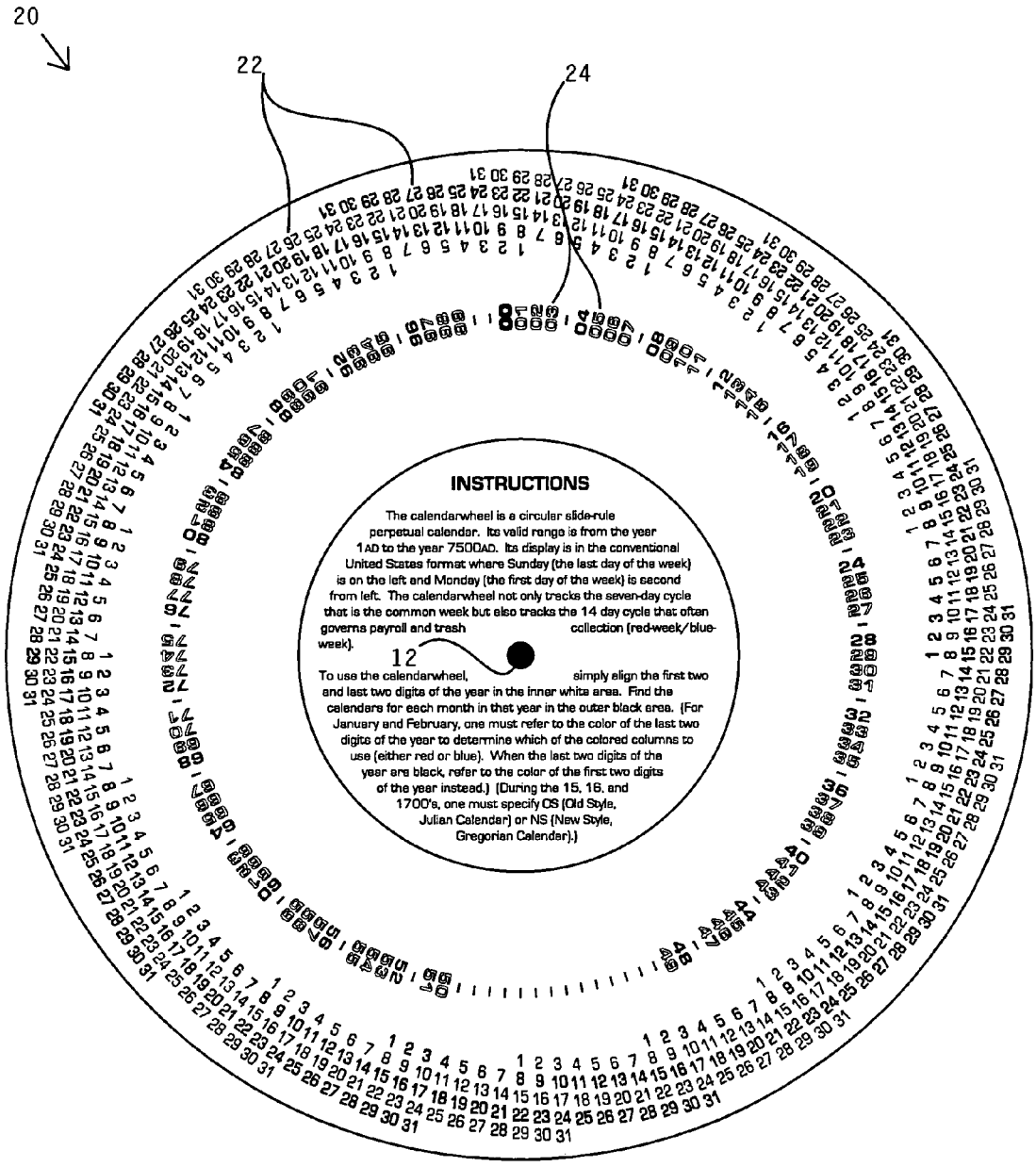
FIG. 2 is a top elevation view of the first wheel member of the perpetual calendar wheel chart.
Figure 3:
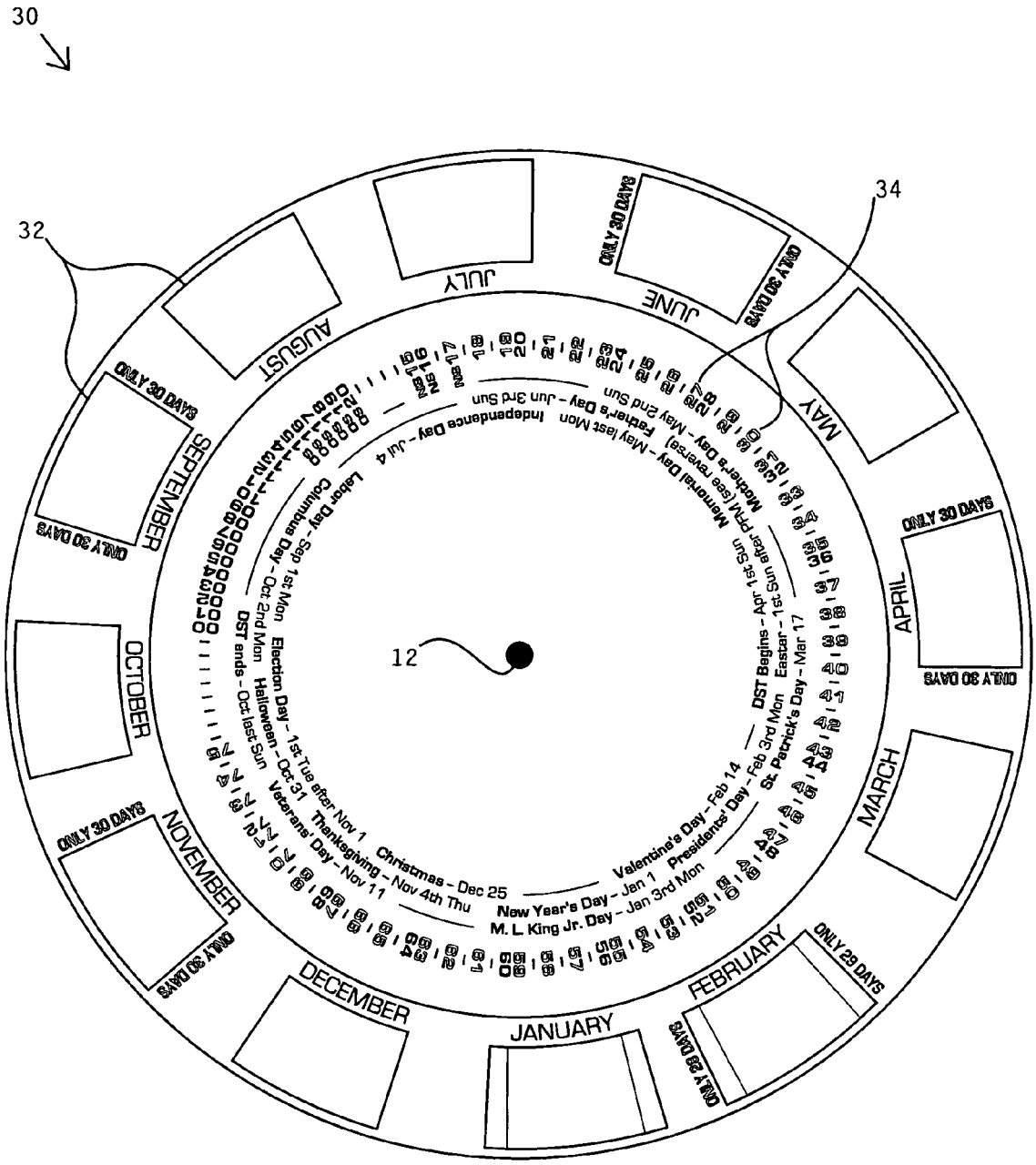
FIG. 3 is a top elevation view of the second wheel member of the perpetual calendar wheel chart.

Referring now to the drawings, it is seen that the perpetual calendar wheel chart of the present invention, generally denoted by reference numeral 10, is comprised of a first wheel member 20, and a second wheel member 30 atop the first wheel member 20. The first wheel member 20, and the second wheel member 30 are adapted to rotate about a common center 12. As seen, each wheel member 20 and 30 has a generally circular shape.

As seen, the first wheel member 20 has around its circumference a plurality of first indicia 22 representing the day of the month and has near its center a plurality of second indicia 24 representing the ones and tens digits of the year. The second wheel member 30 has an inner transparent area 35 and an outer non transparent area 36. The outer area has around its circumference twelve transparent windows 32 representing the twelve months of the year for aligning with the first indicia and has near its center a plurality third indicia 34 representing the hundreds and thousands digits of the year for aligning with the second indicia. As seen, the plurality of first indicia 22 are generally arranged in a spiral.

The plurality of third indicia 34 are of a first color shown as solid and a second color shown as outline to distinguish centuries that are leap centuries containing 36525 days and centuries that are nominal centuries containing 36524 days respectively. The plurality of second indicia 24 are of the first color, the second color, and a third color shown as bold solid to distinguish years that are leap years containing 366 days, years that are nominal years containing 365 days, and years that are either nominal or leap depending on weather the century is nominal or leap respectively. The "spiral arms" of the arrangement of the plurality of first indicia can be alternately of two different colors to indicate weather the week is an odd week or an even week. The reverse of the perpetual calendar wheel chart can be inscribed with tables to permit the calculation of the date of Easter.

In order to use the perpetual calendar wheel chart 10 of the present invention, the second wheel member 30 is rotated so that the third indicia 34 representing the hundreds and thousands digits of the year of interest is aligned with the second indicia 24 representing the ones and tens digits of the year of interest. The alignment of the first indicia with the twelve transparent windows then indicates the calendar for the particular year of interest. There are two possible ways to interpret the calendar for January or February. The proper interpretation is determined by weather the year is leap or nominal and is accomplished by ignoring the leftmost or rightmost column of first indicia 22 appearing through the appropriate transparent window 32 depending on weather the appropriate second indicia 24 is of the first or the second color respectively. If the appropriate second indicia 24 is of the third color, then one considers the color of the appropriate third indicia 34 instead. By way of example, FIG. 1, illustrates the calendar for the year 1900, the year 2001, or the year 2103.

Alternately, the perpetual calendar device 10 may be composed of three wheel members instead of two such that the device is more compact and showing a fewer number of months at one time.

While the invention has been particularly shown and described with reference to an embodiment thereof, it will be appreciated by those skilled in the art that various changes in form and detail may be made without departing from the spirit and scope of the invention.

I claim:

1. A perpetual calendar wheel chart, for determining the calendar for a particular year, comprising:

a first member and a second member, each of a generally circular shape, adapted to rotate about a common center; where the first member has a plurality of first indicia thereon representing the days of the month and has a plurality of second indicia thereon representing a first period of time, each first period of time being either a a year, a decade, or a century; and the second member has a plurality of third indicia thereon representing a second period of time, each second period of time being either a year, a decade, or a century, for aligning the with the second indicia and has at least two transparent windows representing the months of the year for aligning with the first indicia.

2. The perpetual calendar wheel chart as in claim 1 wherein the a least two transparent windows are twelve in number and are each representing one of the twelve months of the year.

3. The perpetual calendar wheel chart as in claim 2 wherein the plurality of first indicia are arranged generally in a spiral pattern.

4. The perpetual calendar wheel chart as in claim 3 wherein the plurality of second indicia and the plurality of third indicia are representing the year and the century.

5. The perpetual calendar wheel chart as in claim 4 wherein the second indicia and the third indicia are of several colors to indicate leap years and leap centuries.

6. The perpetual calendar wheel chart as in claim 5 wherein the plurality of first indicia are of two colors to indicate even weeks and odd weeks.

7. The perpetual calendar wheel chart as in claim 4 wherein the plurality of first indicia are of two colors to indicate even weeks and odd weeks.

8. The perpetual calendar wheel chart as in claim 2 wherein the plurality of second indicia and the plurality of third indicia are representing the year and the century.

9. The perpetual calendar wheel chart as in claim 8 wherein the second indicia and the third indicia are of several colors to indicate leap years and leap centuries.

10. The perpetual calendar wheel chart as in claim 1 wherein the plurality of first indicia are arranged generally in a spiral pattern.

11. The perpetual calendar wheel chart as in claim 10 wherein the plurality of second indicia and the plurality of third indicia are representing the year and the century.

12. The perpetual calendar wheel chart as in claim 11 wherein the second indicia and the third indicia are of several colors to indicate leap years and leap centuries.

13. The perpetual calendar wheel chart as in claim 1 wherein the plurality of second indicia and the plurality of third indicia are representing the year and the century.

14. The perpetual calendar wheel chart as in claim 13 wherein the second indicia and the third indicia are of several colors to indicate leap years and leap centuries.

15. The perpetual calendar wheel chart as in claim 1 wherein the plurality of first indicia are of two colors to indicate even weeks and odd weeks.

* * * * *